US006431965B1

(12) United States Patent
Jones et al.

(10) Patent No.: US 6,431,965 B1
(45) Date of Patent: Aug. 13, 2002

(54) BLASTING APPARATUS WITH A DUAL STRUCTURE DEFLECTOR

(75) Inventors: James A. Jones, Brownsburg; Gregory D. Watkins; Donald G. Wildrick, both of Indianapolis, all of IN (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 64 days.

(21) Appl. No.: 09/639,477

(22) Filed: Aug. 15, 2000

(51) Int. Cl.[7] ..... B24C 9/00

(52) U.S. Cl. ..... 451/89; 451/98; 451/102; 451/450

(58) Field of Search ..... 451/89, 98, 102, 451/449, 450

(56) References Cited

U.S. PATENT DOCUMENTS 6,280,301 B1 * 8/2001 Rogmark ..... 451/188

* cited by examiner

*Primary Examiner*—Timothy V. Eley
*Assistant Examiner*—Alvin J Grant
(74) *Attorney, Agent, or Firm*—Dennis Kelly Sullivan; Jeffrey P. Calfa; Neil T. Powell

(57) ABSTRACT

The invention provides a blasting apparatus with a dual structure deflector. The blasting apparatus includes a blasting cabinet for housing a work piece, a nozzle, a propelling device, and a blasting medium holding unit. In use, the propelling device directs air and blasting medium via a blasting path against a work piece. In one aspect, the dual structure deflector is positioned inside the blasting path and includes an interior structure, an exterior structure, and a tubular support. The interior structure may be made from a rigid material such as steel, aluminum, or another metal. The exterior structure may be made from a resilient material such as polyurethane. The dual structure deflector provides a rigid and impact-resistant configuration.

27 Claims, 3 Drawing Sheets

BLASTING APPARATUS WITH A DUAL STRUCTURE DEFLECTOR

FIELD OF THE INVENTION

This invention relates generally to blasting apparatus. More particularly, this invention relates to blasting apparatus having deflectors or diverters to direct airflow and the flow of blasting medium.

BACKGROUND OF THE INVENTION

Many industrial and other processes use blasting to clean or finish metal and other surfaces. Generally, particles are propelled to impinge against the surface at high speed. Typically, a gas or liquid carries the particles. Alternatively, the particles may be thrown centrifugally by a wheel or similar means.

The particles may be abrasive and non-abrasive and are usually in the shape of shot or grit. Blasting media vary depending upon the particular application and include glass beads, aluminum oxide, steel shot, plastic, and virtually any material having a suitable size and mechanical properties. The particle size depends on the application and the media. The type of particle often describes the type of blasting. For example, shot blasting uses shot as the blasting media. The shot may be made of steel or another material.

The impingement of the particles modifies the surface condition. As a result, blasting is used in many different applications. For example, sand may be removed from castings. Scale may be removed from forgings and other iron and steel products. The flashings and other joining edges may be removed from die castings, plastic parts, and electric circuits. Surfaces may be prepared for painting or other coating applications. Burrs, edges, and other surface imperfections may be removed. Surface characteristics may be altered such as in shot peening, where blasting increase surface stresses thus improving the fatigue life of the material. There are numerous other applications for blasting processes.

Blasting equipment depends upon the application, the blasting media, and similar factors. Generally, a blasting cabinet encloses a work piece during the blasting operation. The blasting cabinet typically has a rectangular structure and is made of metal. The blasting cabinet may be part of a larger process, where the work piece or part is moved on a conveyor into the blasting cabinet. Alternatively, a robotic arm or similar mechanical device may place the work piece into the blasting cabinet. The blasting cabinet may have a rotating or movable table to reposition the work piece during the blasting process.

A propelling device directs the blasting medium into the blasting cabinet and against the surface. The propelling device may be a pressure blasting nozzle system, a suction blasting nozzle system, or a centrifugal wheel, all of which are well known in the art. In the nozzle systems, the propelling device propels air and the blasting medium through a blasting nozzle. The air and medium mixture is accelerated through the nozzle, into the blasting chamber, and against the work piece. The blasting medium ricochets off the work piece and the wall of the blasting cabinet.

The blasting medium usually collects at the bottom of the blasting cabinet. A separator separates the blasting medium from the fines, sand, and other debris from the work piece. A medium-return system returns the blasting medium to the propelling device. Additional blasting medium may be added at that time. A dust collector typically removes particle fines and contaminants from the air before air is released into the environment.

Many blasting devices have a deflector to control the medium flow. The deflector also may be used as a diverter to direct the medium flow against the work piece. The deflector is position inside or at the end of the nozzle. A typical deflector is made of metal and has a flap-shape to cover the nozzle opening. The deflector has a pin or similar rotating means passing through the center of the flap-shape. The deflector rotates about the pin to control the airflow and to direct the medium blasting against the work piece.

Deflectors typically require frequent maintenance and replacement. The nature of the blasting medium and air mixture wears and often warps the deflector. The virtually constant pelting of the deflector by the blasting medium causes the deflector to fail. Prior to failure, the deflector may become misaligned or otherwise distorted. A suitable deflector position for a new deflector may no longer be suitable for a worn deflector.

Accordingly, there is a need for a blasting device having a deflector that withstands the wear warping from the blasting medium.

BRIEF SUMMARY OF THE INVENTION

The invention provides a blasting apparatus with a dual structure deflector. The dual structure deflector provides a rigid and impact resistant configuration, which controls the airflow and flow of blasting medium more accurately and for longer periods than conventional deflectors.

In one aspect, the blasting apparatus includes a blasting cabinet for housing a work piece, a nozzle, a propelling device, and a blasting medium holding unit. The blasting cabinet may have a grating structure, a separator, and a dust collector.

In use, a work piece rests upon a grating structure near the bottom of the blasting cabinet. The propelling device directs air and blasting medium via a blasting path against the work piece. After striking the work piece, the spent blasting medium and material from the work piece pass are collected in a separator or similar structure. The air may pass through a dust collector.

In one embodiment, the dual structure deflector is position in the blasting path to control the airflow and the flow of the blasting medium. The dual structure deflector includes an interior structure, an exterior structure, and a tubular support. The tubular support may extend radially through the center of the interior and exterior structures. In one aspect, each tubular support mounting section has a cavity for receiving a mounting pin. The mounting pins extend through the wall of the nozzle and insert into the cavities of the mounting sections. The dual structure deflector may rotate about the tubular support, thus opening and closing the nozzle.

The following drawings and description provide additional advantages and benefits of the invention. More advantages and benefits are obvious from the description and may be learned by practice of the invention.

BRIEF DESCRIPTION OF SEVERAL VIEWS OF THE DRAWINGS

The invention may be better understood when read in connection with the accompanying drawings, of which.

DETAILED DESCRIPTION OF THE INVENTION

Figure 1:
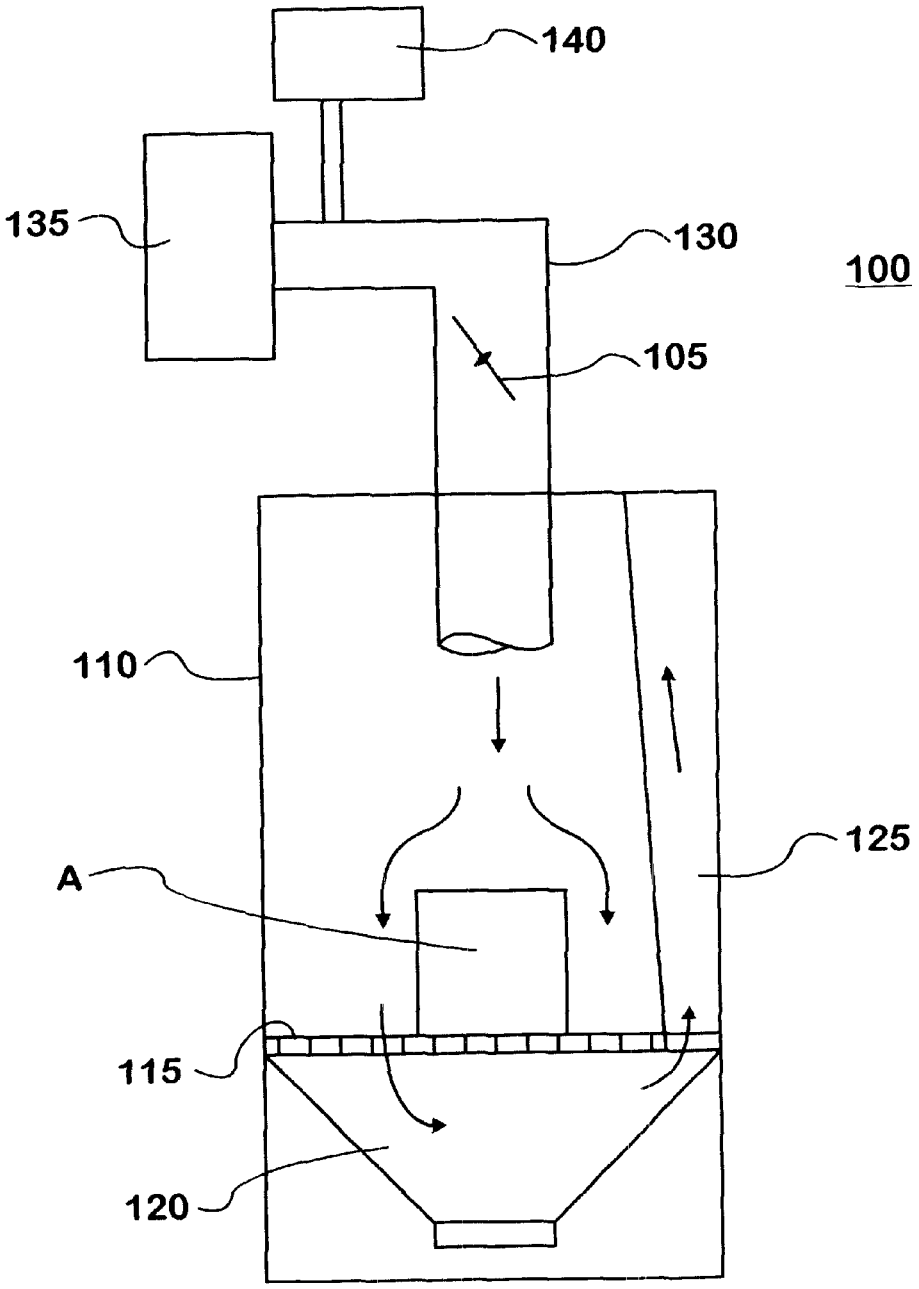
FIG. 1 is a block diagram of a blasting apparatus with a dual structure deflector according to an embodiment of the invention.

FIG. 1 is a block diagram of a blasting apparatus 100 with a dual structure deflector 105 according to an embodiment of the invention. The blasting apparatus 100 includes a blasting cabinet 110 for housing a work piece A. The blasting apparatus 100 also includes a nozzle 130, a propelling device 135, and a blasting medium holding unit 140. While a particular configuration and particular elements are shown and described for the blasting apparatus, other configurations and elements may be used.

In one aspect, the blasting cabinet 110 has a grating structure 115, a separator 120, and a dust collector 125. The blasting cabinet 110 may have a rectangular shape as shown or any other configuration suitable for the blasting operation. The blasting cabinet 110 may have doors (not shown) including an entrance and an exit for use with a conveyor, a similar transportation system, or a material handling system (not shown).

The work piece A rests upon a grating structure 115 near the bottom of the blasting cabinet 110. The grating structure 115 may be a rotating table or other positioning device to move the work piece during the blasting process. When operating, the blasting medium, air, and material from the work piece may pass through the grating structure 115 into a separator 120. In one aspect, the blasting medium settles to the bottom of the separator 120 and air passes through the dust collector 125. The blasting medium may be recycled for later use or recycled and used during the blasting process.

The propelling device 135 may be any of the pressure and suction blasting systems known in the art. The propelling device 135 also may be any propelling device suitable for directing the blasting medium in the appropriate manner against the surface of the work piece. In one aspect, the propelling device 135 directs air or another suitable fluid via a blasting path into the blasting cabinet 110. The propelling device 135 may direct the air and blasting medium through a nozzle 130. The air carries blasting medium from the blasting medium holding unit 140. The blasting medium may be glass beads, aluminum oxide, steel shot, plastic, or any other suitable shot, grit, or the like.

In one aspect, the nozzle 130 protrudes through the blasting cabinet to direct the air and blasting medium mixture onto the work piece. Multiple nozzles (not shown) may be used and from various locations in the blasting cabinet 110.

In one aspect, the dual structure deflector 105 is positioned in the blasting path to control the airflow and flow of the blasting medium. The dual structure deflector 105 may be position inside the nozzle, at either end of the nozzle, or at other locations where deflectors may control the airflow and the flow of the blasting medium. Multiple dual structure deflectors (not shown) may be positioned to control the airflow and flow of blasting medium.

Figure 2:
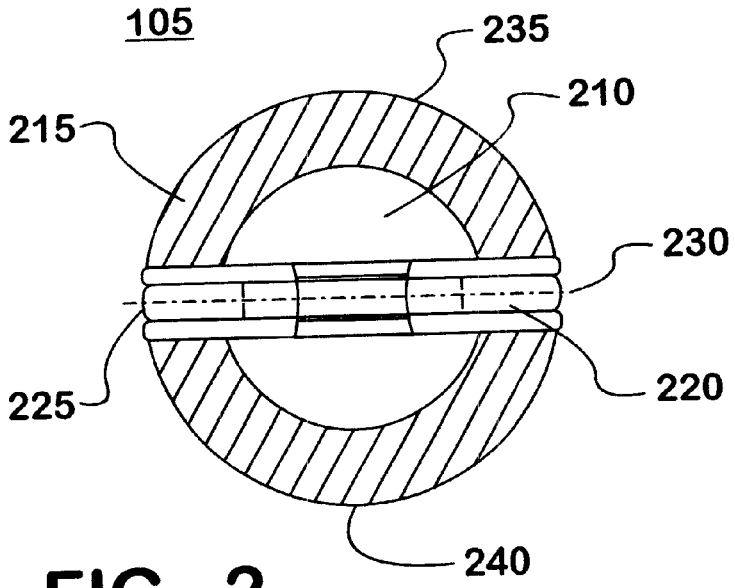
FIG. 2 is a side view of a dual structure deflector according to an embodiment of the invention.
Figure 3:
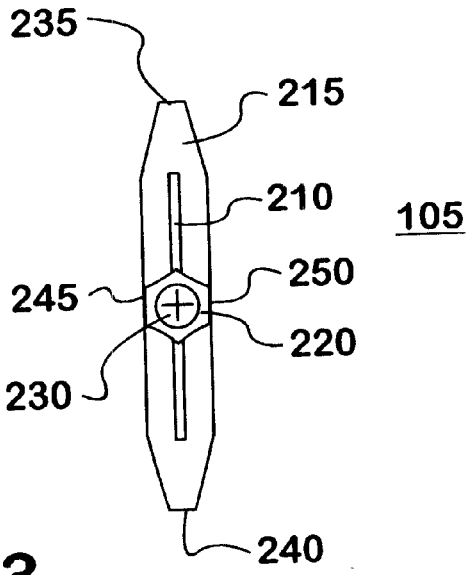
FIG. 3 is an edge view of the dual structure deflector shown in FIG. 2.

FIG. 2 is a side view of a dual structure deflector 105 according to an embodiment of the invention. FIG. 3 is an edge view of the dual structure deflector 105 shown in FIG. 2. The dual structure deflector 105 includes an interior structure 210 and an exterior structure 215. In one aspect, the exterior structure 215 covers the interior structure 210 forming a circular, flap-shaped assembly. Other shapes and configurations may be used.

In one embodiment, a tubular support 220 extends radially through the center of the interior and exterior structures 210, 215. The tubular support has a first mounting section 225 and a second mounting section 230. In one aspect, the first and second mounting sections 225, 230 form cavities for receiving mounting pins (not shown). The tubular support 220 may form only one mounting section, and accordingly may have only on mounting pin. When the deflector is positioned in or at an end of the nozzle 130, the mounting pins extend through the wall of the nozzle 130 and insert into the cavities of the first and second mounting sections 225, 230. The dual structure deflector 105 may rotate about the tubular support 220, thus opening and closing the nozzle 130.

In one aspect, the mounting pins each have a locking screw portion (not shown), which screws into one of the cavities of the first and second mounting sections 225, 230. The locking screw portions "lock" into place, thus enabling one or both to be used to open or close the dual structure deflector 105 appropriately for a desired airflow or flow of blasting medium.

The tubular support 220 may have other configurations as long as the first and second mounting portions 225, 230 are positioned to connect with the mounting pins for opening and closing the dual structure deflector 105. The first and second mounting portions 225, 230 may be separate from each other, i.e., not be part of the tubular support 220.

In one aspect, the interior and exterior structures 210, 215 form a top edge portion 235 and bottom edge portion 240, which are the respective sides formed by the tubular support 220. In one aspect, the top and bottom edge portions 235 and 240 are tapered and may have a taper of about 15° on either side.

In one embodiment, the exterior structure covers the interior structure 210. Alternatively, the interior structure 210 may extend to be even with or protrude slightly from the exterior structure 215 at the top and bottom edge portions 235, 240. In one aspect, the exterior structure 215 covers only the top or bottom of the interior structure 210.

The interior structure 210 may be made from a rigid material such as steel, aluminum, or another metal. Any material may be used for the interior structure 210 as long as the material is suitable for mounting and for preventing the deformation of the dual structure deflector 105 from the airflow and flow of blasting medium.

The exterior structure may be made from a resilient material such as polyurethane. Any material may be used for the exterior structure 215 as long as the material is impact and otherwise resistant to the blasting medium and adheres or otherwise attaches to the interior structure 210.

In one aspect, the dual structure deflector fits inside the nozzle 130 (see FIG.1) of the blasting apparatus 100. The top and bottom edge portions 225, 230 substantially close or seal the nozzle 130 when the dual structure deflector 105 is positioned essentially perpendicular to the nozzle 130. Alternatively, the dual structure deflector 105 may be configured to fit at either end of the nozzle 130 and in other positions to control the airflow and flow of the blasting medium.

Figure 4:
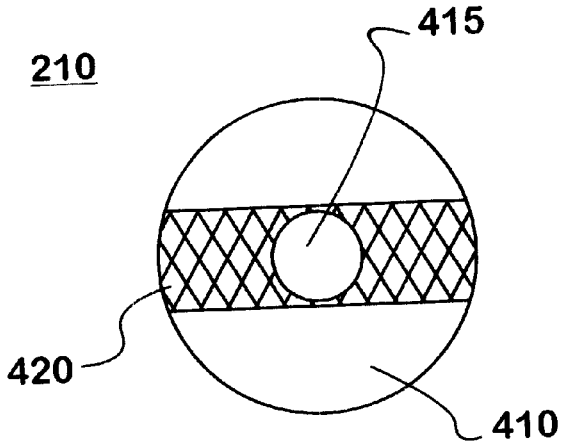
FIG. 4 is a side view of an interior structure prior to assembly with other components of a dual structure deflector according to an embodiment of the invention.

FIG. 4 is a side view of the interior structure 210 prior to assembly with the other components of dual structure deflector 105. In one aspect, the interior structure 210 has a flat, cylinder portion 410 forming a hollow center 415. Other shapes may be used and the hollow center 415 may be omitted. In one aspect, the interior structure 210 is formed with a top groove 420 and a bottom groove (not shown). The top and bottom grooves may be formed by removing material from the interior structure 220. The top and bottom grooves may oppose each other on opposite sides of the interior structure 210. In one aspect, the top and bottom grooves correspond to the shape of the tubular support 220. Alternatively, the interior structure may have only one groove or no groove.

Figure 5:
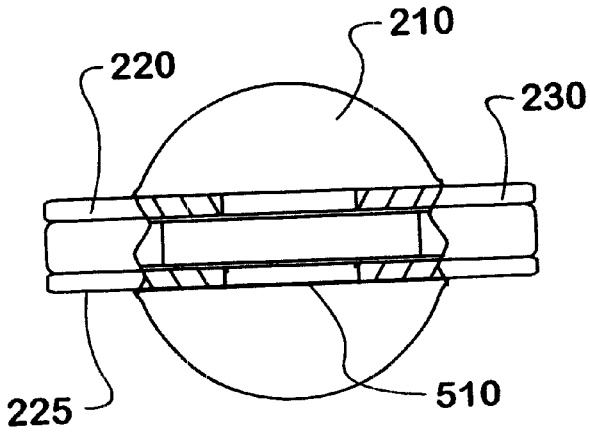
FIG. 5 is a side view of an interior structure and a tubular portion of a dual structure deflector according to an embodiment of the invention.
Figure 6:
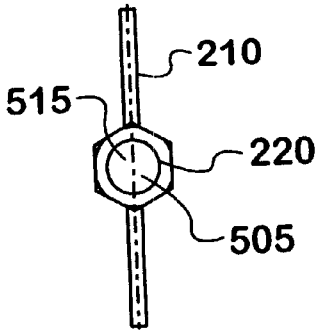
FIG. 6 is an edge view of the interior structure and tubular portion shown in FIG. 5.

FIG. 5 is a side view of the interior structure 210 and the tubular support 220 according to an embodiment of the invention. FIG. 6 is an edge view of the interior structure 210 and tubular portion shown in FIG. 5. In one aspect, the tubular support 220 is split or formed longitudinally along an inside edge 505. The tubular support 220 forms two "half" cylinders, which may or may not be equal. The inside edge 505 of each half cylinder has a recessed portion (not shown) at a midsection 510 between the first and second mounting portions 225, 230. The recessed portions correspond to the diameter of interior structure 210.

When assembled, the half cylinders are positioned in the grooves (see FIG. 4) to reform the tubular support 220 around the interior structure 210. In one aspect, the half cylinders are glued or otherwise made to adhere to the interior structure 210 and/or each other. The recessed portions permit formation of the first and second mounting portions 225, 230 with an essentially complete tubular shape (i.e., without a gap). Without the recessed portions, the first and second mounting portions 225, 230 may be formed with a gap. The first and second mounting portions 225, 230 form cavities 515 for receiving the mounting pins. In another aspect, the tubular section 220 is not split or formed into halves. In this case, the tubular section remains whole and is positioned on one side of the interior structure 210 within or without a groove.

Referring to FIGS. 2 and 3, the exterior structure 215 is formed on the interior structure 210 and tubular support 220. The exterior structure 215 may cover both or only one of the top and bottom of the interior structure 210. The exterior structure 215 may be formed by plating, chemical vapor deposition, and similar processes. In one aspect, the exterior structure 215 is castable or pourable, setting or curing into a final shape. The interior structure 210 and tubular support 220 are positioned in a mold having the desired shape of the dual structure deflector 105. The material for the exterior structure 215 is poured into the mold and permitted to set or cure. In one aspect, the tubular support 220 has a square-like or hexagonal outer surface. The tubular support 220 may be positioned in the mold to expose at least one outer surface 245, 250 through the exterior structure 215. The at least one outer surface 245, 250 may be even or in the same plane as the surface of the exterior structure 215.

Together, the interior and exterior structures 210, 215 and the tubular support 220 provide a dual structure deflector 105 with a rigid and impact resistant configuration. The dual structure deflector 105 controls the airflow and flow of blasting medium more accurately and for a longer period of time before maintenance and replacement is necessary.

While the invention has been described and illustrated, this description is by way of example only. Additional advantages will occur readily to those skilled in the art, who may make numerous changes without departing from the true spirit and scope of the invention. Therefore, the invention is not limited to the specific details, representative machines, and illustrated examples in this description. Accordingly, the scope of this invention is to be limited only as necessitated by the accompanying claims.

What is claimed is:

1. A blasting apparatus comprising:

a blasting cabinet;

a propelling device operatively connected to the blasting cabinet, the propelling device to provide a blasting medium via a blasting path against a work piece in the blasting cabinet; and at least one dual structure deflector operatively positioned within the blasting path between the propelling device and the work piece, the dual structure deflector controllable to selectively vary the direction and quantity of blasting medium striking the work piece.

2. A blasting apparatus according to claim 1, wherein the blasting path is through a nozzle protruding into the blasting cabinet.

3. A blasting apparatus according to claim 2, wherein the at least one dual structure deflector is operatively positioned inside the nozzle.

4. A blasting apparatus according to claim 1, wherein the propelling device is one of a pressure blasting system and a suction blasting system.

5. A blasting apparatus according to claim 1, further comprising a positioning device.

6. A blasting apparatus according to claim 1, wherein the at least one dual structure deflector further comprises:

an interior structure having a top and a bottom;

an exterior structure covering at least one of the top and bottom; and a tubular support connected to the interior structure.

7. A blasting apparatus according to claim 6, wherein the blasting path is through a nozzle protruding into the blasting cabinet;

the tubular support forms at least one mounting section having a cavity; and at least one mounting pin operatively disposes the at least one dual structure deflector inside the nozzle, the mounting pin being disposed inside the cavity.

8. A blasting apparatus according to claim 6, wherein the interior structure has at least one groove and the tubular support is positioned in the at least one groove.

9. A blasting apparatus according to claim 8, wherein the tubular support comprises a first half and a second half, wherein the at least one groove comprises a top groove and a bottom groove, wherein the first half is disposed in the first groove and the second half is disposed in the second groove.

10. A blasting apparatus according to claim 6, wherein the interior structure is made of steel.

11. A blasting apparatus according to claim 6, wherein the exterior structure is made of polyurethane.

12. A dual structure deflector for selectively varying direction and quantity of a blasting medium striking a work piece in a blasting apparatus, comprising:

an interior structure having a top and a bottom;

an exterior structure covering at least one of the top and bottom; and a tubular support connected to the interior structure.

13. A dual structure deflector according to claim 12, wherein the interior structure has at least one groove in at least one of the top and bottom, and wherein the tubular support is positioned in the at least one groove.

14. A dual structure deflector according to claim 12, wherein the tubular support comprises a first half and a second half, wherein the at least one groove comprises a top groove and a bottom groove, wherein the first half is disposed in the first groove and the second half is disposed in the second groove.

15. A dual structure deflector according to claim 12, wherein the tubular support comprises a first half and a second half, wherein at least one of the first half and second half has a recessed portion connected to the interior structure.

16. A dual structure deflector according to claim 12, wherein the exterior structure covers the interior structure.

17. A dual structure deflector according to claim 12, wherein interior structure is made of steel.

18. A dual structure deflector according to claim 12, wherein the exterior structure is made of polyurethane.

19. A dual structure deflector according to claim 12, wherein the tubular structure forms at least one mounting section having a cavity to receive a mounting pin.

20. A blasting apparatus comprising:

a blasting cabinet;

a propelling device operatively connected to the blasting cabinet, the propelling device to provide a blasting medium via a blasting path into the blasting cabinet, wherein the blasting path is through a nozzle protruding into the blasting cabinet; and at least one dual structure deflector operatively positioned within the blasting path, the dual structure deflector to control the blasting medium, wherein the at least one dual structure deflector is operatively positioned inside the nozzle.

21. A blasting apparatus comprising:

a blasting cabinet;

a propelling device operatively connected to the blasting cabinet, the propelling device to provide a blasting medium via a blasting path into the blasting cabinet wherein the blasting path is through a nozzle protruding into the blasting cabinet; and at least one dual structure deflector, operatively positioned within the blasting path to control the blasting medium, the at least one dual structure deflector comprising:

an interior structure having a top and a bottom, an exterior structure covering at least one of the top and bottom, a tubular support connected to the interior structure, the tubular support forms at least one mounting section having a cavity, and at least one mounting pin operatively disposes the at least one dual structure deflector inside the nozzle, the mounting pin being disposed inside the cavity.

22. A blasting apparatus comprising:

a blasting cabinet;

a propelling device operatively connected to the blasting cabinet, the propelling device to provide a blasting medium via a blasting path into the blasting cabinet; and at least one dual structure deflector, operatively positioned within the blasting path to control the blasting medium, the at least one dual structure deflector comprising:

an interior structure having a top, a bottom and at least one groove;

an exterior structure covering at least one of the top and bottom, and a tubular support connected to the interior structure and positioned in the at least one groove.

23. A blasting apparatus comprising:

a blasting cabinet;

a propelling device operatively connected to the blasting cabinet, the propelling device to provide a blasting medium via a blasting path into the blasting cabinet; and at least one dual structure deflector, operatively positioned within the blasting path to control the blasting medium, the at least one dual structure deflector comprising:

an interior structure having a top, a bottom and at least one groove, wherein the at least one groove comprises a top groove and a bottom groove, an exterior structure covering at least one of the top and bottom, and a tubular support comprising a first half and a second half, the tubular support connected to the interior structure and positioned in the at least one groove, wherein the first half is disposed in the first groove and the second half is disposed in the second groove.

24. A dual structure deflector for a blasting apparatus, comprising:

an interior structure having a top, a bottom and at least one groove in at least one of the top and bottom;

an exterior structure covering at least one of the top and bottom; and a tubular support connected to the interior structure wherein the tubular support is positioned in the at least one groove.

25. A dual structure deflector for a blasting apparatus, comprising:

an interior structure having a top, a bottom and at least one groove in at least one of the top and bottom wherein the at least one groove comprises a top groove and a bottom groove, an exterior structure covering at least one of the top and bottom; and a tubular support connected to the interior sore, the tubular support comprising a first half and a second half wherein the first half is disposed in the first groove and the second half is disposed in the second groove.

26. A dual structure deflector for a blasting apparatus, comprising:

an interior structure having a top and a bottom;

an exterior structure covering at least one of the top and bottom; and a tubular support connected to the interior structure, the tubular support comprising a first half and a second half wherein at least one of the fist half and second half has a recessed portion connected to the interior structure.

27. A dual structure deflector for a blasting apparatus, comprising:

an interior structure having a top and a bottom;

an exterior structure covering at least one of the top and bottom; and a tubular support connected to the interior structure wherein the tubular support forms at least one mounting section having a cavity to receive a mounting pin.

* * * * *